US011053560B2

(12) United States Patent
Andress, IV et al.

(10) Patent No.: US 11,053,560 B2
(45) Date of Patent: Jul. 6, 2021

(54) HIGH PRESSURE RAPID GAS QUENCHING VACUUM FURNACE UTILIZING AN ISOLATION TRANSFORMER IN THE BLOWER MOTOR POWER SYSTEM TO ELIMINATE GROUND FAULTS FROM ELECTRICAL GAS IONIZATION

(71) Applicants: George G. Andress, IV, Warminster, PA (US); William R. Jones, Telford, PA (US)

(72) Inventors: George G. Andress, IV, Warminster, PA (US); William R. Jones, Telford, PA (US)

(73) Assignee: William R. Jones, Telford, PA (US)

( * ) Notice: Subject to any disclaimer, the term of this patent is extended or adjusted under 35 U.S.C. 154(b) by 124 days.

(21) Appl. No.: 15/999,873

(22) Filed: Aug. 24, 2018

(65) Prior Publication Data

US 2020/0063225 A1 Feb. 27, 2020

(51) Int. Cl.

| | |
|---|---|
| ***C21D 1/667*** | (2006.01) |
| ***F27B 5/16*** | (2006.01) |
| ***F27B 5/04*** | (2006.01) |
| *F27B 5/06* | (2006.01) |
| *F27D 21/00* | (2006.01) |

(52) U.S. Cl.

CPC ..... *C21D 1/667* (2013.01); *F27B 5/04* (2013.01); *F27B 5/16* (2013.01); *F27B 2005/062* (2013.01); *F27D 2021/0057* (2013.01)

(58) Field of Classification Search

CPC ..... C21D 1/667; F27B 2005/062; F27B 5/04; F27B 5/16

USPC ..... 266/249, 250, 252, 259; 432/247, 432/200–205; 373/5, 110, 112, 117, 118, 373/124, 125, 135, 150

See application file for complete search history.

(56) References Cited

U.S. PATENT DOCUMENTS 4,124,199 A * 11/1978 Jones ..... C23C 8/36 266/250

4,141,539 A * 2/1979 Bornor ..... C21D 1/767 236/15 BF (Continued)

*Primary Examiner* — Scott R Kastler
*Assistant Examiner* — Michael Aboagye

(57) ABSTRACT

An integral high pressure rapid quenching vacuum furnace utilizing an electrical isolation transformer in the blower motor power control system in order to isolate the motor windings, reduce the possibility of gas ionization and eliminate ground faults, particularly when quenching in argon gas, is described. In order to achieve the desired mechanical properties of certain metal alloys being quenched using argon gas as a quenching medium in the high pressure gas vacuum furnace chamber, a 600 HP—460 Volt motor is required. A 460 Volt primary—460 Volt secondary [delta-delta] isolation transformer, having input and output windings separated by an electrostatic shield connected to ground is placed between the power source and the gas blower motor in the quenching chamber filled with argon gas. The 460 Volt power source is connected to a variable frequency drive (VFD) and the VFD is connected to the primary transformer winding. The secondary transformer winding connects 460 Volts to the blower motor windings. The full electrical isolation of the transformer secondary winding results in zero ground fault voltage.

11 Claims, 5 Drawing Sheets

(56) References Cited

U.S. PATENT DOCUMENTS

| | | | | |
|---|---|---|---|---|
| 5,127,823 | A * | 7/1992 | Bonner | F23N 5/203 431/46 |
| 6,428,742 | B1 | 8/2002 | Lemken | |
| 8,088,328 | B2 | 1/2012 | Jones | |
| 9,187,799 | B2 * | 11/2015 | Wilson | C21D 9/0043 |

* cited by examiner

HIGH PRESSURE RAPID GAS QUENCHING VACUUM FURNACE UTILIZING AN ISOLATION TRANSFORMER IN THE BLOWER MOTOR POWER SYSTEM TO ELIMINATE GROUND FAULTS FROM ELECTRICAL GAS IONIZATION

BACKGROUND OF THE INVENTION

1. Field of the Invention

The present invention relates to a high pressure above 2 Bar vacuum heat treating furnace, either an integral quench or an external quench design, capable of rapidly cooling the heat treated materials by gas quenching using argon gas at pressures at 10 Bar or higher.

2. Description of the Prior Art

A high pressure vacuum heat treating furnace of the type utilized in the present invention is fully described in U.S. Pat. No. 9,187,799 (Wilson et al.), the disclosure of which is incorporated herein by reference. Although the Wilson et al. design covers only an integral quench vacuum furnace in which the quench system is intimately connected to the furnace hot zone, the present invention is also applicable to external quench systems such as described in U.S. Pat. No. 8,088,328 (Jones), or any external or integral quench design.

Typical quenching gases used in the vacuum furnace industry include nitrogen, hydrogen, helium and argon, or some combinations of these gases. Hydrogen gas presents potential safety issues such as explosive dangers under certain conditions. As more and more specialty alloys contain elements that are reactive to nitrogen, and with restrictions on helium usage due to the worldwide shortage of helium production, argon has become a major quench gas for specialty alloys. Argon gas is the least efficient for cooling due to its much lower thermal conductivity. Typically, argon is blended with some helium up to a 50/50 ratio to provide the higher quenching rates needed for specialty alloys. The cost of helium is approximately ten times the cost of argon, so a significant cost reduction was sought. As the vacuum furnace industry continues to look for faster and more effective quenching capabilities, larger fan motors are required. In order to generate the speed needed to fill the furnace chamber quickly and recycle the gas between the hot zone and the water-cooled heat exchanger, the use of an internal gas blower system is required, as described in Wilson et al.

However, the lower thermal conductivity of argon makes it a less effective quench gas because of its decreased cooling rate, and as a result requires higher pressures and faster recirculation times from the beginning of the quench. As previously stated, argon is generally less effective as a quenching medium due to its much lower thermal conductivity and thus relative cooling capacity compared to nitrogen, helium or hydrogen. The relative cooling rates of the quench gases are as follows: hydrogen—1.50; helium—1.33; nitrogen—1.00; and argon—0.76 (Fabian, Roger; Vacuum Technology. Practical Heat Treating and Brazing; ASM International Materials; Park, Ohio, 1993; page 55). The cooling capacity or cooling coefficient is a measure of the rate of heat removal per unit area per degree of temperature—"Optimizing Gas Quenching" by George C. Carter, Published Advanced Materials and Processes, 1996, reprint available at www.solaratm.com.

The only way to provide the necessary quenching rates with argon at pressures at 10 bar or higher is to increase the fan blower motor horsepower, as explained by Carter as follows:

> "There are three key factors that determine heat transfer in vacuum furnaces. They are cooling or heat transfer coefficient (H); temperature difference between the parts being heat treated and the recirculated gas, and the surface area of the parts exposed to the gas (S). Since the temperature difference between the load and the recirculating gas stays relatively constant for a specific heat treating process, the only way to significantly affect the cooling rate in gas quenching is to increase HP, as F and S are factors that remain constant. HP is the remaining factor that plays the key role in high pressure gas quenching. The following equation expresses the mathematical relationship for H:

$$H=kGS^{0.47}(\mathrm{HP})^{0.23}F$$

where:

k=constant dependent on type of gas used

G=gas type

S=surface area of parts being quenched/cooled

HP=gas blower horsepower

F=furnace coefficient

To compensate for the lower thermal heat transfer effectiveness of argon by convection, the argon gas must be able to move at much faster speeds from its introduction compared to nitrogen or a blend of argon and helium at pressures up to and greater than 10-Bar. For vacuum furnaces as described in Wilson et al. the HP required to cool the workload with all argon gas at 10-Bar is a minimum of 600 HP in order to achieve the quench rates of the argon/helium blend currently used to meet the necessary mechanical and metallurgical properties for certain alloys.

Unfortunately, argon gas has a lower dielectric breakdown voltage than any other quenching gas, and as such requires an alternative blower motor power design to avoid unwanted electrical arcing within the blower motor. When using argon, the fact exists that it can ionize under certain high voltage conditions. This means that if an electrical discharge occurs in the presence of argon, plasma or an arc can occur. As the voltage going into the motor increases above a set voltage, any short circuits to ground between the motor windings will result in a flashover. A glow discharge will be generated that could damage the motor windings and shut down the motor completely, thus terminating the quench cycle. This unacceptable result is a damaged motor and spoiled or damaged workload inside the furnace chamber resulting in incorrect mechanical properties of the parts being heat treated.

These shortcomings led to the design of the present invention vacuum furnace blower motor power system, having an integral quench system capable of providing quench pressures up to or greater than 10 Bar using 100% argon gas. This design is capable of meeting the necessary quench speed to satisfy the required specification for certain mechanical and microstructural properties.

Argon breaks down under applied low voltages, which is referred to as dielectric breakdown. Less than 50 Volts is required to start a glow discharge in argon. This condition would provide a path between the windings of a transformer to ground resulting in a short circuit. An autotransformer (step down) could be used to step the voltage down to 230 Volts. However, the gas velocities with lower voltage would not meet the quench rates required during the initial quench stage. A step-down transformer is not a full isolation transformer. Line to ground will cause short circuits within the blower motor.

Backfilling the furnace chamber with argon using a 460 Volt motor will increase the possibility of argon gas ionization and a short circuit within the blower motor during the quench cycle. As previously discussed, ionization forms plasma and results in an electrical breakdown causing a ground fault condition. To prevent such an occurrence the electrical design for connecting the fan blower motor to the power line had to be redesigned from prior art designs. The present invention provides such a redesigned electrical circuit arrangement to allow for safe practice using 100% argon in a vacuum furnace quenching system utilizing a blower motor rated to run at 460 Volts.

The present design includes a 600 HP-460 Volt blower motor attached to a variable frequency drive (VFD), which is also known as a variable speed drive (VSD), and quenches in 100% argon gas at rates that current conventional designs using 230 Volt motors cannot achieve. The 460 Volt motor is connected to a full isolation transformer to ensure that there is a ground-to-earth safety feature incorporated by virtue of the isolation design. The present design is unique in that the current general teachings indicate that the highest voltage allowed in an argon atmosphere is 230 Volts. The only prior art publication indicating the use of 460 Volts in a high pressure gas quenching vacuum furnace internal system uses nitrogen as the quenching gas. This can be found in U.S. Pat. No. 6,428,742 (Lemken) at column 1, line 15, and column 3, line 56.

Prior art furnace blower motors of greater than 300 HP receiving 460 Volts use an autotransformer to step down 460 Volts to 230 Volts for use in argon as well as nitrogen. All prior art gas quenching furnaces use this method to start the quenching cycle. The use of a 460 Volt blower motor has previously been used only for a nitrogen quench cycle, which starts at 230 Volts up to a maximum pressure then converts to 460 Volts above 750 mBar, as described in Lemken, which specifies nitrogen as the quenching medium. This type of cycle using a step-down transformer with an increase in supply voltage to the blower fan motor at a set higher pressure has not been used with pure argon. A blower motor with voltage greater than 230 Volts has not been used upon initiation of any gas quench cycle, especially argon. Accordingly, the present invention is an improvement over prior art vacuum furnaces. As previously discussed, when 460 Volts supply power is introduced into the windings of a blower motor in an argon atmosphere during a quench cycle, there is a possibility of ionizing the argon gas. If the motor windings become conductive due a short circuit, severe damage to the blower motor and the parts being heat treated will occur.

As will be fully described in the 'Detailed Description of the Invention,' power source voltage causes spikes or surges that can wipe out the blower motor even when it is powered down. Use of a variable frequency drive (VFD), (or variable speed drive—VSD), varies the 60 cycle frequency of the current to the motor and changes the speed of the motor. This is described in Wilson et al. at column 5, line 59 to column 6, line 3. The change in frequency can also cause spikes, so a spike preventer must be added to the VFD, which is referred to as a Delta 3-phase metal oxide varistor (MOV) device that filters and clamps transient electrical currents or serves as a voltage spike suppressor to filter and clamp the transients to ground. A varistor is a variable resistor, more commonly referred to as a voltage dependent resistor (VDR), which is a nonlinear voltage dependent device with an electrical behavior closely resembling back-to-back Zener diodes. When exposed to very high voltage transients, the MOV impedance changes dramatically from a nearly open circuit to a highly conductive level, thus dropping the transient voltage to safer levels. The MOV clamps those potential transients, absorbing the energy and thereby protecting the blower motor windings from exposure to higher unexpected voltage that could lead to short circuits and damage the motor. This protective circuitry is very important, especially when the blower motor is located within an ionizing gas such as argon.

The variable frequency drive (VFD) can also cause spikes as the frequency is changed. When the frequency is changed, aborted waveforms can occur that cause a sudden spike in voltage. These spikes can also cause breakdown and damage to the motor. A varistor (motor terminator) is attached to the motor on the opposite side of the isolation transformer from the variable frequency drive (VFD) to protect the motor from any spikes from the VFD aborted waveforms. When a VFD is used, the sinusoidal wave is squared off rather than remaining sinusoidal. The peaks of the squared-off wave can result in transients that could eventually damage the motor winding insulation resulting in a short circuit.

The use of the isolation transformer originates from the ability to isolate or separate the primary motor winding from the secondary winding, thus eliminating ground faults when a 460 Volt motor-to-line design is in use. As an added layer of protection, the present invention isolation transformer includes an additional new feature whereby an electrostatic shield is placed between the primary and secondary windings to prevent transient voltage transfer, as will be shown in the drawings and described in the detailed description of the invention.

The vacuum furnace according to the present invention is designed to quench with argon at 10-Bar pressure while utilizing a 600 HP motor running at 460 Volts from a variable speed drive, and rear head movable gas baffle door, as described in Wilson et al. The goal of the massive quench system is to be able to quench larger batches of power generation castings by increasing the cooling rate and eliminating the supplemental use of helium, while operating in 100% argon. This has proved to be successful in operation, as will be demonstrated in the 'Time vs Temperature' graph shown in FIG. 5. The furnace incorporates a proprietary control system that allows for complete process automation.

The following comparison is to a similar sized furnace that cannot meet the quench rate in 100% argon, as it is limited to a 300 HP motor with a step-down to a 230 Volt transformer. The quench rates for the two identical runs are shown in the graph in FIG. 5. As can be seen, the use of 100% argon in accordance with the present invention has a cooling rate equivalent to the cooling rate for the 20% helium/80% argon runs currently used in the production cycle that is limited to a 230 Volt blower motor. The elimination of helium from the quenching gas results in substantial cost savings, as the worldwide helium shortage has made the cost of this gas prohibitively expensive for routine use.

SUMMARY OF THE INVENTION

This invention is related to an integral high pressure rapid quenching vacuum furnace utilizing an electrical isolation transformer in the blower motor power control system in order to isolate the motor windings, reduce the possibility of gas ionization and eliminate ground faults, particularly when quenching in argon gas.

In one of its aspects this invention provides a high pressure vacuum furnace for heat treating and rapid gas quenching in argon atmosphere in the same furnace comprising a single chamber having blower means therein, the vacuum furnace comprising power source means, and isolation transformer means operatively connected to the power source means, and wherein the blower means being operatively connected to the isolation transformer means, the isolation transformer means having primary winding means, secondary winding means and electrostatic shield means therebetween, the primary winding means receiving electric power from the power source means, and the blower means receiving electric power from the secondary winding means.

DETAILED DESCRIPTION OF THE DRAWINGS

DETAILED DESCRIPTION OF THE INVENTION

Figure 1:
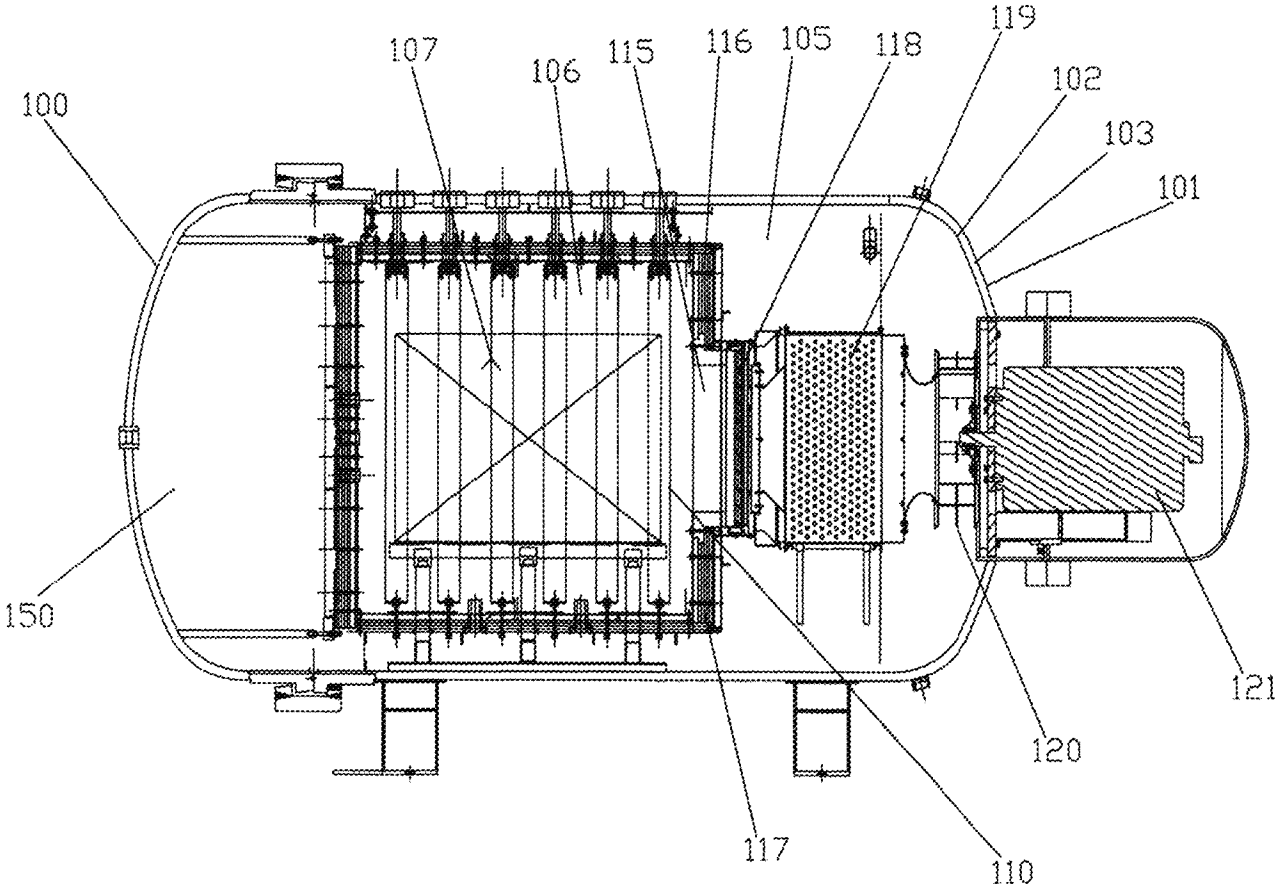
FIG. 1 depicts in perspective a side horizontal closed door cross-section view of a high temperature vacuum—high pressure quench heat treating furnace 100.

Referring to the drawings wherein like reference numerals refer to the same or similar elements across the multiple views, FIG. 1 depicts in perspective a side horizontal, closed door cross-section view of a high temperature—high pressure integral quench heat treating furnace 100. As fully described in Wilson et al., the disclosure of which is fully incorporated herein by reference, the term integral includes the movable doors, baffles, heat exchanger and blower assembly all interconnected within a single chamber, all of which will be fully described below. The circuitry for the blower assembly, using an increased horsepower motor greater than the 300-400 HP motor described in Wilson et al. in a 100% argon quench gas, is the key improvement of the present invention.

FIG. 1 shows furnace 100 that includes a hinged door 150 which is opened to allow the insertion of a work piece to be heat treated, and then closed during the heat treating cycle. Outer wall 101 and inner wall 102 of furnace 100 form the radial boundaries of a furnace water jacket 103 used for cooling outer furnace wall 101. The outer chamber of furnace 100 thus is a cylindrical double-walled, water-cooled vessel. Inner wall 102 also forms the outer wall of a spacious gas plenum chamber 105, which is a large annular cavity that is important to high velocity, rapid quenching.

The inner wall 102 of gas chamber 105 forms a hot zone 106 of vacuum furnace 100. Hot zone 106 includes a work zone 107 for heat treating a work piece placed in the furnace. It should be understood that the term work piece can refer to a single piece or multiple pieces to be heat treated and rapidly quenched. It should also be understood that the dimensions of the hot zone could be advantageously varied to accommodate larger sized work pieces. Reference is made to Wilson et al., the disclosure of which is fully incorporated herein by reference for a complete description of the arrangement of furnace 100.

Still referring to FIG. 1, at the rear end of hot zone 106 is a circular wall (not shown) which comprises an opening 115 containing movable radiation baffle doors 116 and 117. When doors 116 and 117 are opened, baffles 118 are exposed to direct gasses from hot work zone 110 outward into a water-cooled copper-finned heat exchanger 119, and thereafter to a recirculating fan wheel 120. Recirculating fan wheel 120 receives its power from a 600 HP-460 Volt blower motor 121, which is attached to fan wheel 120. Baffles 118 serve two purposes. The first purpose is to act as a radiation barrier between the hot work zone 110 and the heat exchanger 119. Upon opening the radiation baffle doors 116 and 117, all radiant energy from the hot work zone 110 would otherwise transfer immediately into and overwhelm heat exchanger 119, leading to its rapid failure. Baffles 118 serve to deflect radiation energy back into the hot work zone 110 in a similar fashion as a metal heat shield in a typical all metal hot zone, which reflects radiant heat back towards the work piece during a heating cycle, and also serves to avoid heat losses during the heating cycle. This leaves only convective heat energy via the hot gases as the source of heat that must be removed by heat exchanger 119. Reducing the effects of any source of radiant heat energy decreases the heat load placed on heat exchanger 119 during the quenching cycle, thus minimizing various maintenance issues typically required for heat exchangers that deal with both radiation and convection heat loads.

Figure 2:
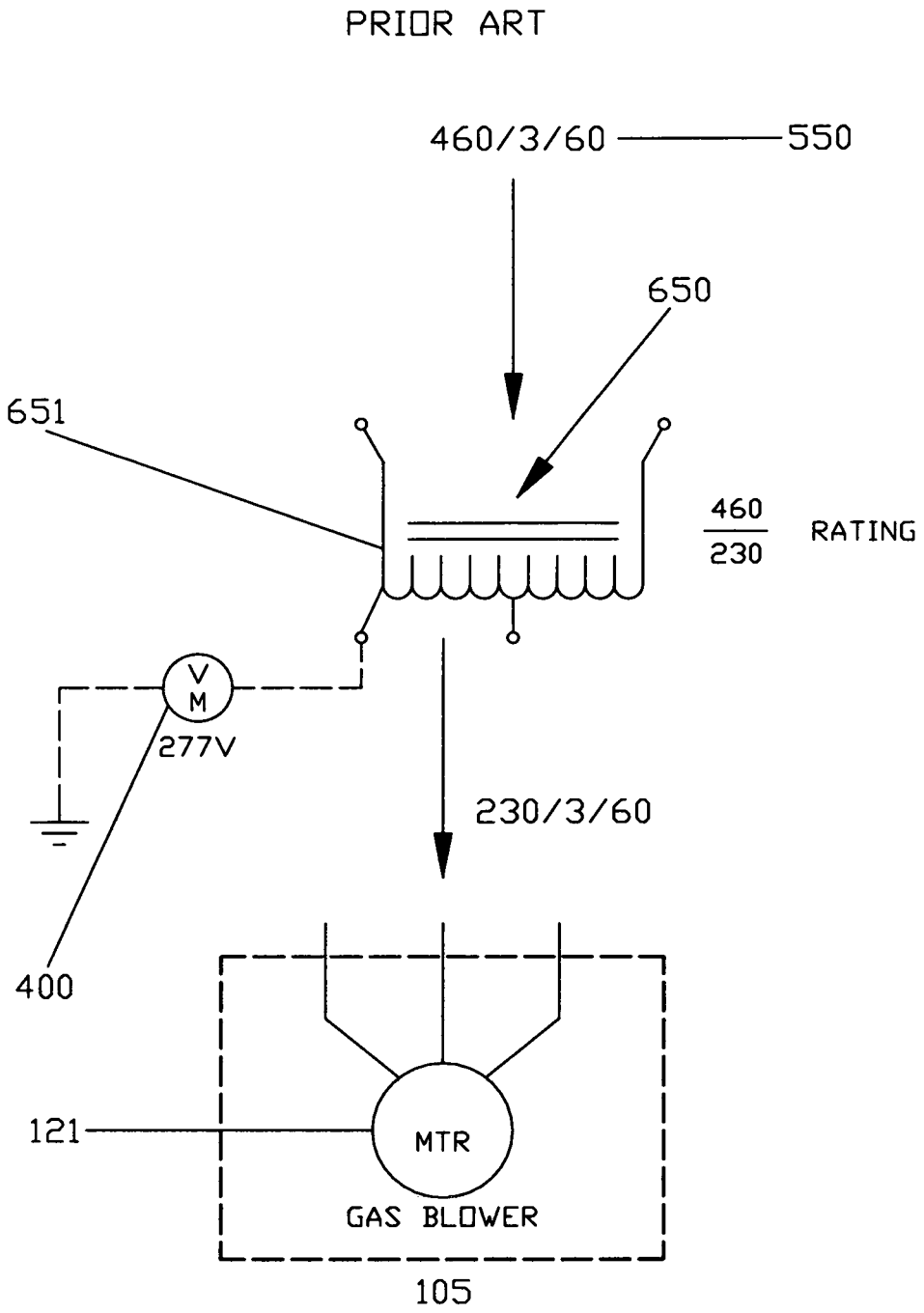
FIG. 2 depicts a prior art step-down transformer circuit used in a high temperature vacuum—high pressure quench heat treating furnace 100.
Figure 3:
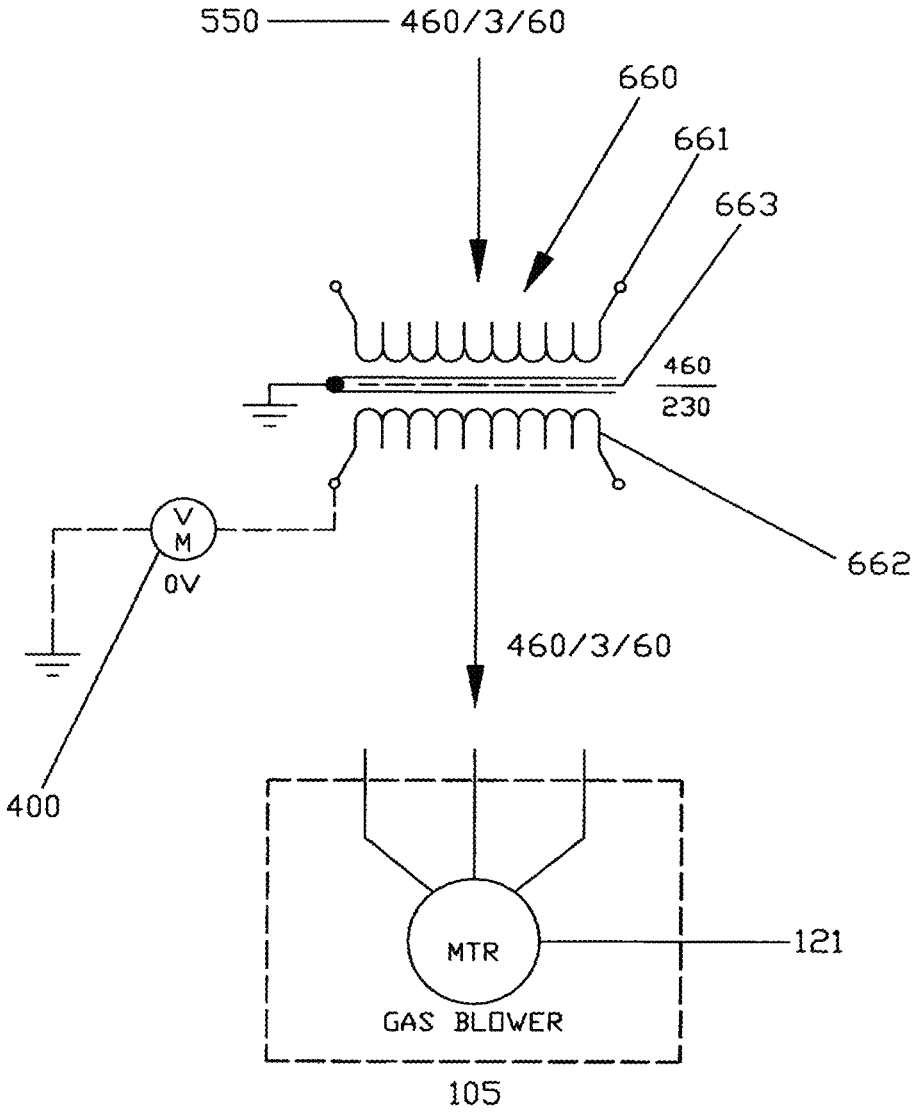
FIG. 3 depicts an isolation transformer circuit used in a high temperature vacuum—high pressure quench heat treating furnace 100 in accordance with the present invention.

FIGS. 2 and 3 are simplified electrical schematic drawings of the ground to current voltage that is always present when a 460 Volt motor is connected to the power supply. The use of a prior art autotransformer 650 is shown in FIG. 2, and the present invention isolation transformer 660 showing power source and voltage to ground is shown in FIG. 3. As depicted in FIG. 2, prior art blower motors used in high pressure gas quenching vacuum furnaces rely on an autotransformer 650 to drop the 460 Volts entering the building down to 230 Volts. Autotransformer 650 consists of a single winding 651 that is connected to the initial power supply 550 on its input side, and is connected to blower motor 121 on its output side with the voltage reduced to 230 Volts. With this arrangement a measure of the voltage to ground using a voltmeter 400 connected in parallel to the output of winding 651, the reading could be as high as 277 Volts to ground. This high voltage to ground can result in extraneous electrical current inside blower motor 121 and cause ionization of the argon gas, resulting in an electrical short circuit. Conversely, the use of an isolation transformer 660 shown in FIG. 3 eliminates such a possibility. A simplified electrical schematic in FIG. 3 consists of a power supply 550 connected to the primary winding 661 of isolation transformer 660. Primary winding 661 is separated from the secondary winding 662 by an electrostatic shield 663, that acts as a voltage or current isolator between the primary and secondary windings that could possibly ionize the argon gas. Both electrostatic shield 663 and secondary winding 662 are connected to ground. The output of secondary winding 662 is also at 460 Volts and is connected to the input of blower motor 121, which is connected to the same ground as secondary winding 662 of isolation transformer 660. With this arrangement a measure of the voltage to ground using a voltmeter 400 connected in parallel to the output of secondary winding 662, the reading would be essentially zero, thus eliminating any ground voltage that could ionize the argon gas and cause an electrical short circuit.

As stated previously in the background of the invention, there is a recognition that submerging a motor with greater than 230 Volts into an ionizing gas significantly increases the probability of creating an arc which would damage not only the motor, but also the furnace and any material being heat treated. The National Fire Protection Association standards and other recognized electrical codes for these type of vacuum furnaces include recommendations that a motor cannot exceed 230 Volts in the presence of an ionizing gas such as argon. Since the applicable standards and the established prior art have included the use of an autotransformer, the present invention represents an improvement when using integral high pressure argon gas quench systems. The inclusion of a 460 Volt motor submerged in an ionizing gas such as argon in order to create gas quenching speeds required to meet certain strict cooling rates has not previously been utilized.

Figure 4:
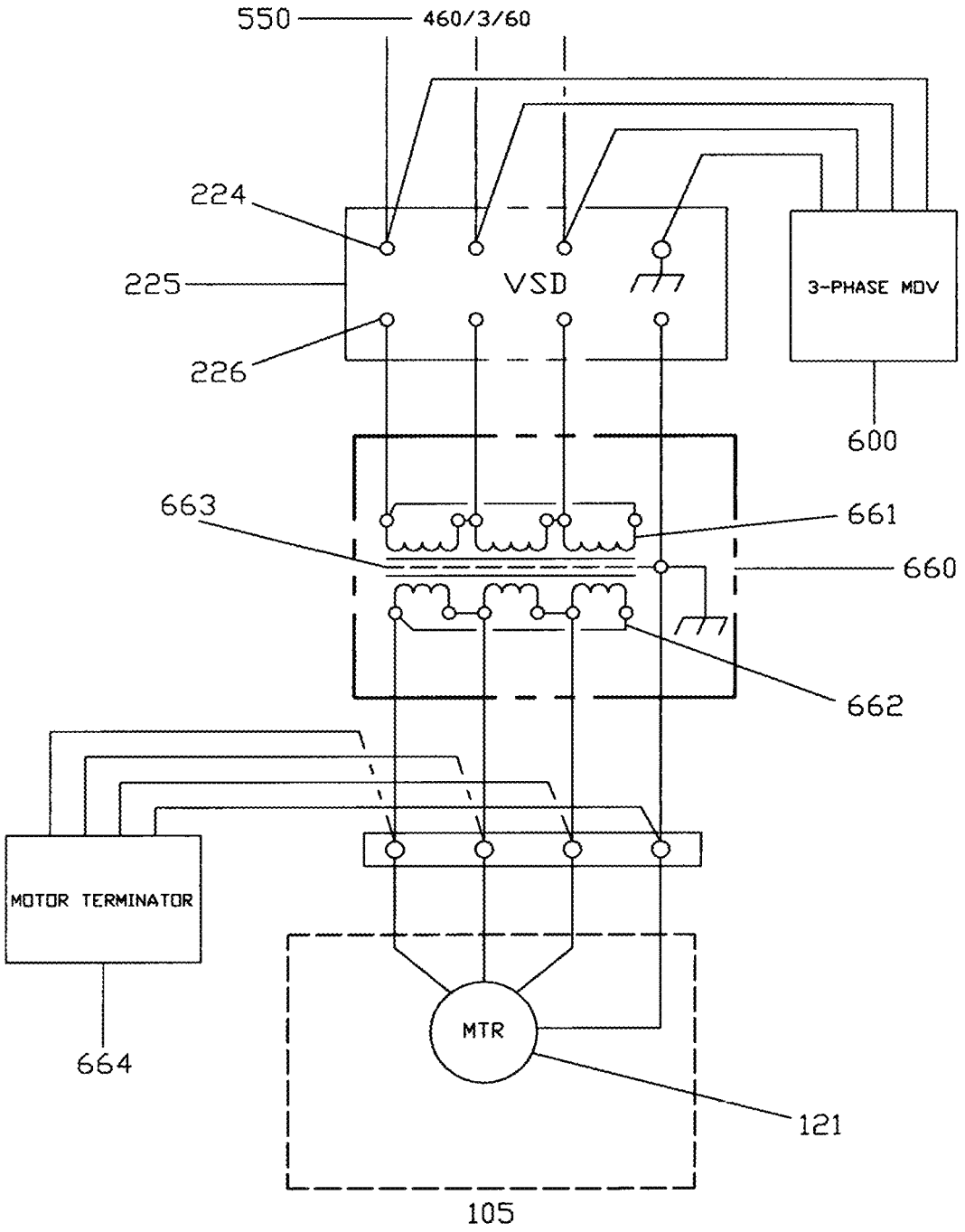
FIG. 4 depicts the complete blower motor circuit in accordance with the present invention.
Figure 5:
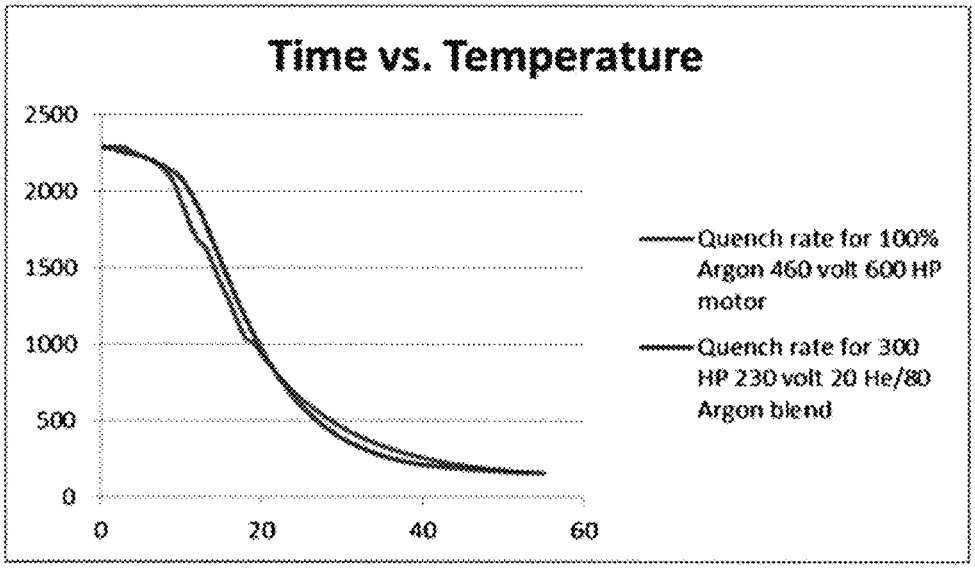
FIG. 5 depicts a comparison of quench rates for two identical runs using 100% argon versus 20% helium/80% argon.

FIG. 4 depicts in its entirety the actual power connections between the utility power supply, the various components including the connection of the variable speed drive 225 used to regulate the speed of the blower fan, the isolation transformer 660, and the blower motor 121. Also shown are two different types of varistors that serve as insurance against random voltage spikes that occur during the transfer of power from the power supply to the blower motor. A varistor is a variable resistor, sometimes referred to as a voltage dependent resistor. Each component of the design plays a role in significantly reducing the probability of an ionizing occurrence in the presence of argon gas.

In FIG. 4 the utility power supply 550 is connected to the input side of a variable speed drive 225. A 3-phase metal oxide varistor (MOV) is connected in parallel to the input side 224 of variable speed drive 225. The output side 226 of variable speed drive 225 is connected to primary winding 661 of isolation transformer 660. Secondary winding 662 is connected to the input of blower motor 121. As an added layer of protection, an electrostatic shield 663 is located between the primary 661 and secondary 662 windings of isolation transformer 660 to shield the windings from any electrical voltage spikes that may occur between the two windings. Also attached to the blower motor in parallel with secondary winding 662 is a motor terminator 664, which is a varistor that protects the motor from unwanted distorted waveforms from the variable speed drive 225 to the blower motor 121. When the variable speed drive 225 is used, the typical non-distorted or pure sinusoidal voltage waveform is squared off. Over time the squared-off waves can result in transients or voltage spikes that can enter the blower motor 121 and cause damage to the motor winding insulation. Damage to the wire insulation would result in a short circuit current within the motor windings. Motor terminator 664 will work as a sacrificial current absorber and keep such transient voltage peaks from entering the motor.

Although the use of isolation transformers in the electrical technology is not new, for this particular application the use of a 460 Volt rated motor in the presence of specifically argon gas, but also other quench gases such as nitrogen and helium, is new and inventive The present invention goes beyond the current teachings regarding use of a motor in an ionizing gas and provides the opportunity for quenching in argon gas at pressures that have not previously been achieved because of prior art industry electrical limitations.

While there has been described what is believed to be a preferred embodiment of the present invention, those skilled in the art will recognize that other and further modifications may be made thereto without departing from the spirit and scope of the invention. It is therefore intended to claim all such embodiments that fall within the true scope of the invention.

What is claimed is:

1. A high pressure vacuum furnace for heat treating and rapid gas quenching in argon atmosphere in the same furnace comprising a single chamber and access means, the chamber being segregated into an outer portion and an inner portion, the inner portion of the chamber being a hot zone and being adapted to receive a work piece to be heat treated through the access means, the furnace further including movable door means in the chamber outer portion in a form of movable doors formed to be closed during a heat treating cycle and opened during a quenching cycle, the furnace chamber outer portion further including heat exchanger means, blower means and baffle means formed to deflect the radiant energy of the hot zone passing into the outer portion of the chamber through an opening created by the movable doors being in the open position back through the opening into the inner portion hot zone of the chamber, and wherein the baffle means is further formed to diffuse a convective heat energy of the hot gases passing through the opening and to distribute a convective heat energy evenly over a full surface area of the heat exchanger means during the quenching cycle, the baffle means being located in the outer portion of the chamber juxtaposed from the movable doors, and wherein the heat exchanger means being located in proximity to the baffle means and the blower means, and the blower means being located in proximity to the heat exchanger means for circulating argon gas into the inner portion hot zone of the chamber to quench the work-piece, an improvement comprising:

power supply means, isolation transformer means operatively connected to said power supply means, and wherein the blower means being operatively connected to said isolation transformer means, said isolation transformer means having primary winding means, secondary winding means connected to ground, and electrostatic shield means between said primary winding means and said secondary winding means, said electrostatic shield means being connected to ground, said primary winding means receiving electric power from said power supply means, and the blower means receiving electric power from said secondary winding means, and motor terminator means operatively connected to the blower means, and wherein all of the blower means, said motor terminator means and said isolation transformer means are operatively connected to ground.

2. A vacuum furnace in accordance with claim 1 wherein the vacuum furnace further includes variable speed drive means and metal oxide varistor means both operatively connected to said power supply means, and wherein all of said power supply means, said variable speed drive means and said metal oxide varistor means are operatively connected to ground.

3. A vacuum furnace in accordance with claim 1 wherein the power from said power supply means to said primary winding means is 460 Volts, 3-phase, 60 cycles.

4. A vacuum furnace in accordance with claim 1 wherein the blower means includes motor means, and wherein the power to said motor means from said secondary winding means is 460 Volts, 3-phase, 60 cycles.

5. A vacuum furnace in accordance with claim 1 wherein the pressure in the vacuum furnace is up to 10 Bar.

6. A vacuum furnace in accordance with claim 1 wherein the pressure in the vacuum furnace is in excess of 10 Bar.

7. A vacuum furnace in accordance with claim 1 wherein the vacuum furnace includes baffle means, and wherein said baffle means is in a form of a chevron configuration.

8. A vacuum furnace in accordance with claim 1 wherein the vacuum furnace includes variable speed drive means, and wherein said variable speed drive means is operatively connected on its input side to said power supply means, and is operatively connected on its output side to said isolation transformer means.

9. A vacuum furnace in accordance with claim 1 wherein the vacuum furnace includes 3-phase metal oxide varistor means, and wherein said 3-phase metal oxide varistor means is operatively connected in parallel with said power supply means to an input side of said variable speed drive means.

10. A vacuum furnace in accordance with claim 4 wherein the vacuum furnace includes motor terminator means, and wherein said motor terminator means is operatively connected in parallel with said secondary winding means to said blower motor means.

11. A vacuum furnace in accordance with claim 10 wherein said motor terminator means comprises varistor means.

* * * * *